United States Patent [19]

Kocolowski

[11] 4,253,267

[45] Mar. 3, 1981

[54] NATIVITY SCENE HOUSING CONSTRUCTION

[76] Inventor: Theodore Kocolowski, 14 Manor Ct., Joliet, Ill. 60436

[21] Appl. No.: 941,221

[22] Filed: Sep. 11, 1978

[51] Int. Cl.[3] ..... A63H 33/06

[52] U.S. Cl. ..... 46/19; 434/72

[58] Field of Search ..... 46/19, 21, 20, 12, 13, 46/16, 17; 35/16; 428/3

[56] References Cited

U.S. PATENT DOCUMENTS

| | | | |
|---|---|---|---|
| 1,492,560 | 5/1924 | Fisher | 46/19 |
| 2,441,761 | 5/1948 | Guelicher | 46/19 |
| 3,228,137 | 1/1966 | Runser | 46/19 X |
| 3,906,659 | 9/1975 | Walmer | 46/19 |

FOREIGN PATENT DOCUMENTS

| | | | |
|---|---|---|---|
| 519128 | 2/1931 | Fed. Rep. of Germany | 46/19 |

*Primary Examiner*—Gene Mancene
*Assistant Examiner*—Mickey Yu

[57] ABSTRACT

A housing which takes the form of a model or replica of a larger structure such as the stable which was the birthplace of Jesus. The housing can be assembled and disassembled repeatedly and without the use of permanent fasteners such as nails or glue. The housing includes a generally rectangular base having slots provided near the peripheral edges on the upper surface thereof. Front and rear panel members are respectively inserted into a parallel pair of slots along the longer dimension of the base. A pair of side members are respectively inserted into a second pair of parallel slots disposed along the shorter dimension of the base. The vertical edges of the panel and side members are respectively received within corresponding slots of four corner members wherein each corner member includes a pair of transversely oriented slots and an inclined upper surface. First and second generally rectangular, peaked roof members are each provided with a pair of parallel slots on the lower surfaces thereof and along the longer dimensions thereof. The upper edges of the panel members extend above the inclined surfaces of the corner members and are received within the corresponding slots of the roof members in press-fit frictional engagement therewith. The spacing of the roof member slots pretensions and urges the panel members toward one another, and the engagement of the inclined surfaces with the sloped roof members precludes horizontal translation of the assembled corner members.

7 Claims, 13 Drawing Figures

NATIVITY SCENE HOUSING CONSTRUCTION

BACKGROUND OF THE INVENTION

This invention relates to a small-scale housing such as a Nativity scene enclosure, a dollhouse, and the like, and particularly, to such a housing which is of knockdown construction which may be easily assembled and disassembled, repeatedly.

Enclosures which function as miniature Nativity scenes are well-known and have been widely used in the art, essentially since the time of Christ. In the prior art, these enclosures or housings, which are provided as complete, permanent structures, have several disadvantages with respect to commercial manufacture and consumer use. For example, even though the enclosures are a model or a miniature replica, they are relatively large—e.g., so as to accommodate the miniature figurines, the manger and other articles disposed therein. Accordingly, their relatively large size requires large shipping containers which are not only expensive to transport but also require substantial retail store shelf space, as well as consumer storage space when the enclosure is stored for the next Holiday season. Further, these permanent structures require additional manufacturing steps to assembly and suitably fasten the respective members such as by means of nails, screws, staples or glueing, as is well known in the art. This additional labor only adds additional expense to the ultimate consumer.

These and other disadvantages are overcome by the present invention wherein there is provided a housing which takes the form of a replica of a larger structure such as the Nativity scene stable dwelling. The housing is provided of knockdown construction which may be rigidly assembled without using nails, glue or other conventional fasteners and which may be stored in a relatively flat package when the unit is disassembled for some future use.

SUMMARY OF THE INVENTION

Briefly, a housing forming a small-scale replica of a dwelling or the like is provided. The housing comprises a base having at least one slot therein on one surface thereof which extends along at least a substantial portion of the peripheral edge of the base. A front panel member and a rear panel member are removably insertable in the flat of the base, and a pair of side members are removably insertable into the slot at opposite ends of the panel members. A plurality of vertically extending corner members are respectively disposed at the various intersections of the panel and side members, wherein each corner member includes a slot for receiving a vertically extending edge portion of at least one of the panel and side members. A roof is provided which includes first and second depending roof members each having a pair of slots therein for removably receiving the upper edge portions of the panel members in press-fit, frictional engagement therewith.

BRIEF DESCRIPTION OF THE DRAWING

The advantages of this invention will become more readily appreciated as the same becomes better understood by reference to the following detailed description when taken in conjunction with the accompanying drawing wherein.

DETAILED DESCRIPTION

Figure 1:
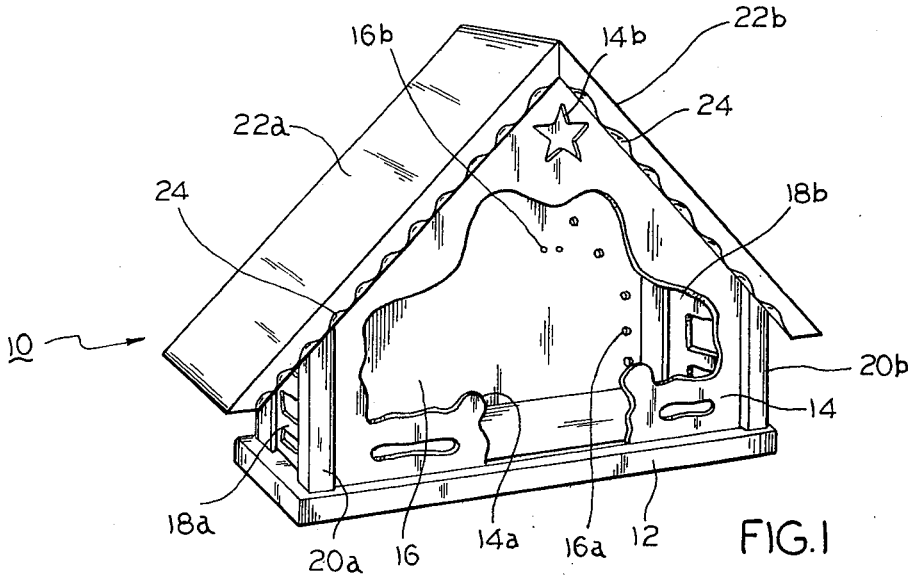
FIG. 1 is a perspective view of the housing in accordance with the present invention.

Referring now to FIG. 1, there is shown generally at 10 the housing which forms a small-scale replica of a dwelling or the like in accordance with the present invention. Housing 10 includes a generally rectangular base member 12 which is provided with a slot or slots along its peripheral upper edge surface therein. A front panel member 14 is received within the front slot portion base 12 and a rear panel member 16 is similarly disposed within a slot in the rear portion of base 12. A pair of side members 18*a* and 18*b* are removably inserted into base 12 at opposite ends of the front and rear panel members. Each of the intersections of the side and panel members are provided with a corner member such as corner members 20*a* and 20*b* of FIG. 1. As will be discussed more fully hereinafter, the upper portion of each of the corner members is provided with an inclined surface which engages a respective one of roof members 22*a* and 22*b*. Roof members 22*a* and 22*b* may include integral ornamental features such as scallops 24. Front panel 14 is provided with an artistic cutout opening so as to form rustic fence portions as well as an access opening into housing 10. Front panel 14 may also include a star-shaped opening 14*b* which simulates the star of Bethlehem. Rear panel 16 includes a plurality of holes or throughbores 16*a* therein which can be utilized to insert miniature Christmas lights therein. Rear panel 16 also includes a pair of centrally and upwardly disposed bores as at 16*b*. These bores can be utilized to fasten a figurine, such as an angel, to the upper portion of the rear panel, as by way of the angel's sash.

As will be discussed more fully hereinafter, housing 10 is assembled by utilizing a press-fit frictional engagement of the respective members relative to one another. That is, the front and rear panel members as well as the side members are inserted into corresponding grooves or slots provided along the upper surface of base 12. Thereafter, the respective corner members are inserted into the side and panel members at the four intersections thereof. In this regard, each corner member is preferably provided with a pair of transversely oriented slots extending along the length thereof respectively on two adjacent surfaces thereof. Thereafter, the roof members, each of which are provided with a pair of slots along the longer peripheral edges thereof, are inserted onto the vertically projecting upper edges of the front and rear panel members. In this regard, the height of the front and rear panel members is selected so that the upper edges thereof extend above the upper surfaces of the corner members a distance corresponding to the depth of the slots provided in the roof members. The spacing of the respective slot pairs of the roof members is provided such that the front and rear panel members are resiliently urged toward one another in the assembled condition of housing 10. Thus, a pretension is provided which functions to enhance the press-fit, frictional engagement of the assembled housing 10. Further, the upper surfaces of the corner members are provided as inclined surfaces the angles of which are complimentary to the assembled angle of the roof members so that the upper surfaces of the corner members are in engagement with the lower surfaces of the roof members. Accordingly, the corner members are also captured by the roof members in their assembled configuration wherein horizontally outward movement of the corner members is precluded by the engagement of the inclined surfaces with the roof members.

It has been found that once housing 10 is assembled into its press-fit frictional engagement, that the assembly is complete and can be readily moved about without causing separation of the respective members of the housing. In this regard, it has been found that the assembled housing 10 can be carried and moved, even by the roof members, without causing separation or disassembly of the respective members.

Moreover, it will now be appreciated by those skilled in the art, that housing 10 can be assembled without the use of nails, screws, staples, glue or other conventional fastening devices and without the use of tools. That is, the entire assembly operation can be rapidly and conveniently completed entirely by hand operations. Further, assembly 10 can be disassembled and reassembled repeatedly and in the disassembled state housing 10 can be stored in a convenient relatively flat package or container.

Figure 2A:
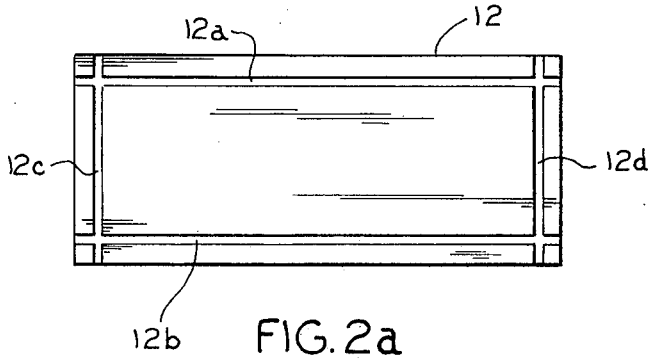
FIGS. 2*a* and 2*b* are plan and end views, respectively, of the base member of the housing of FIG. 1.
Figure 2B:
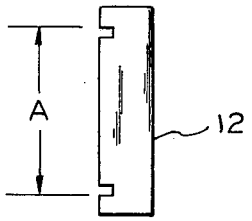

Referring now to FIGS. 2*a* and 2*b* there are shown top and end views of base member 12 in accordance with a preferred embodiment of the present invention. It can be seen that base 12 is provided with a pair of parallel grooves or slots 12*a* and 12*b* extending near the peripheral edge along the longer dimension of base 12. Similarly, base 12 is provided with a second pair of parallel slots 12*c* and 12*d* extending along the peripheral edges of the shorter dimension of base 12. As previously alluded to, the spacing of slots 12*a* and 12*b* (dimension A in FIG. 2*b*) is selected so as to provide a pretensioned assembly of housing 10.

Figure 3A:
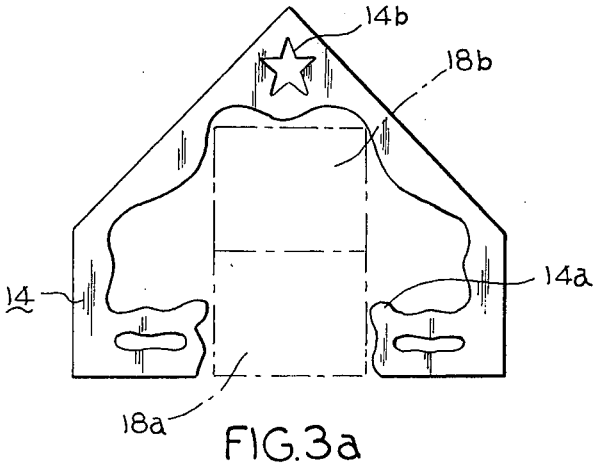
FIGS. 3*a* and 3*b* are plan views of the front and rear panel members of the housing in accordance with the present invention.
Figure 3B:
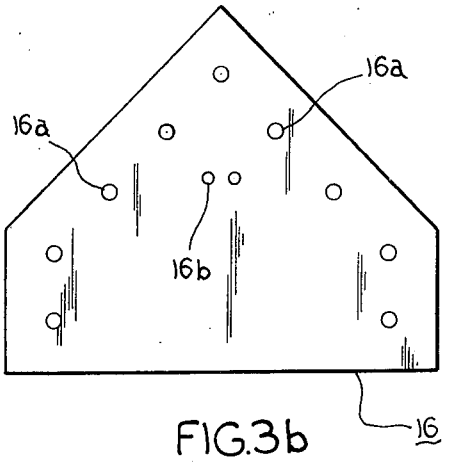
Figure 4:
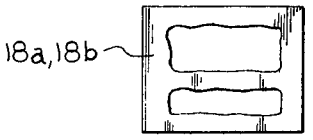
FIG. 4 is a plan view of one of the two identical side members of the housing of FIG. 1.

Referring now to FIGS. 3*a* and 3*b* there are shown front views of the front and rear panel members, respectively. The side members 18*a* and 18*b* are illustrated in FIG. 4. In currently preferred practice, these members are formed from $\frac{1}{4}''$ common panelling and the various associated slotted members are provided with a corresponding slot with on the order of $\frac{1}{4}''$. It can be seen by reference to FIG. 3*a* that the unused or otherwise scrapped portion of panel 14, which forms the artistic cutout 14*a*, can also be utilized to provide both of the side members, 18*a* and 18*b*. Also in currently preferred practice, the height of panel members 14 and 16 is on the order of 12" whereas the width is on the order of 16". These dimensions not only provide a housing of a suitable size within which to place the associated figurines, but the preferred sizes also permit twelve housings to be constructed from a single 4 by 8 foot sheet of paneling. That is, a single sheet of panelling can be cut into three 8 foot strips of 16" width which are thereafter cut in eight sections thereby to provide twenty-four blank panels or twelve finished pairs.

Figure 5A:
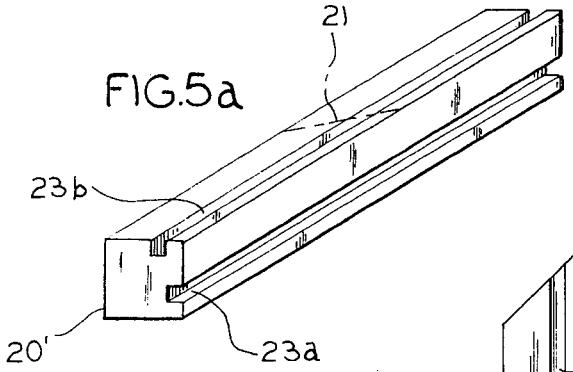
FIGS. 5*a–d* provide various views of the corner members of the housing of FIG. 1.
Figure 5D:
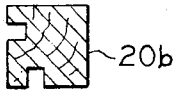
Figure 5B:
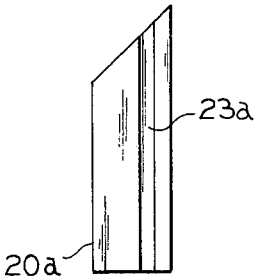
Figure 5C:
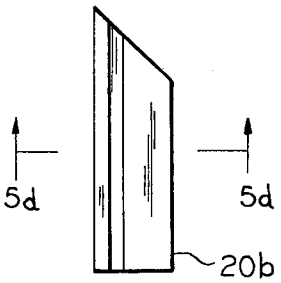

Referring now to FIGS. 5*a–d* there are shown various views of the corner members is accordance with the principles of the present invention. FIG. 5*a* illustrates one manner in which the corner members can be constructed or fabricated. For example, corner member 20' may be formed from a given length of one by one lumber in which a pair of slots 23*a* and 23*b* are milled, routed or dadoed therein. Thereafter, the milled stock is cut to the desired length and an angular cut 21 is provided. As previously indicated, the width of slots 23*a* and 23*b* is on the order of the thickness of the wall panels of housing 10. FIGS. 5*b* and 5*c* illustrates side views of corner members 20*a* and 20*b* respectively; and FIG. 5*d* provides a cross-sectional view taken along the line 5*d*—5*d* of FIG. 5*c*. It will be appreciated by those skilled in the art that the corner members of diametrically opposed corners of housing 10 are essentially identical but differ from the corner members of the other diametrically opposed pair of corner members due to the angular configuration of the upper inclined surfaces thereof. That is, the corner pairs are different but related as the right hand is related to the left. It will also be appreciated by those skilled in the art that the corner members 20*a* and 20*b* can be provided in any one of a given number of suitable forms. For example, the corner member can be extruded plastic or aluminum members and the cross-sectional configuration thereof can be varied to meet the needs of a given ornamental design.

Figure 6A:
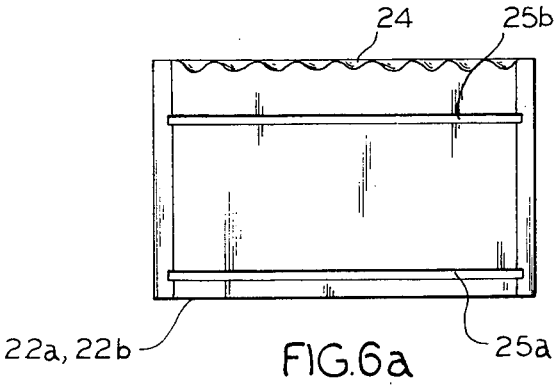
FIGS. 6*a* and 6*b* provide plan and end views, respectively, of one of the roof members of the housing in accordance with the previous drawing figures.
Figure 6B:
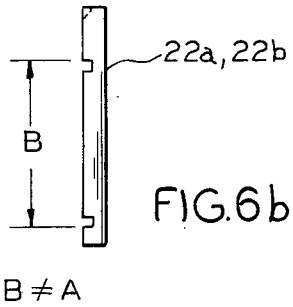

Referring now to FIGS. 6*a* and 6*b* there are shown plan and end views of roof members 22*a* and 22*b*. Roof member panels 22*a* and 22*b* are provided with a single pair of slots 25*a* and 25*b* disposed along the peripheral edge of the roof members along the longer dimension thereof. It has been found that a single pair of slots are sufficient to complete the assembly of housing 10. That is, the side members are adequately retained by the corner members without corresponding slots in the roof members. However, it will be appreciated by those skilled in the art that each of the roof members can be provided with an additional slot or groove which receives an upwardly extending portion of the respective side member. This modification has the advantage that further locking is ensured even if the fit between the roof and panel member wears loose as by continued use and the passage of time.

FIG. 6*b* also illustrates the spacing B of the slots of roof members 22*a* and 22*b*, and sets forth the preferred relationship of spacing B to that of spacing A of base member 12. It can be seen that since $B \neq A$ the front and rear panel members will be pretensioned toward or away from one another in their assembled condition giving rise to a relatively rigid assembly of housing 10.

Figure 7:
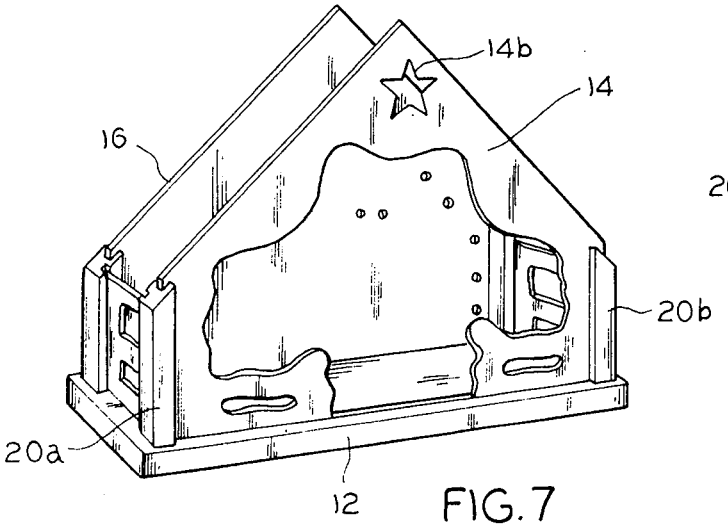
FIG. 7 is a perspective view of the housing, in accordance with the principles of the present invention, shown partially assembled; and, FIG. 8 is a partial view illustrating the relationship between one of the corner and roof members in accordance with the principles of the present invention.
Figure 8:
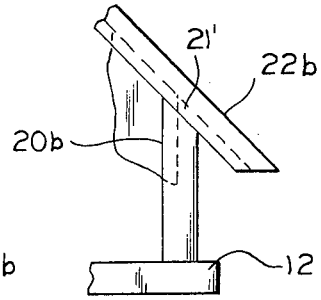

Referring now to FIG. 7 there is shown another perspective view of housing 10 in its partially assembled condition. It can be seen that once the front and rear panel members are inserted and the corner members are positioned, and the side members are slid into the installed corner members, the partially completed assembly is ready to receive the roof members. The roof members are thereafter inserted over the upwardly projecting edge portions of front and rear panel members 14 and 16 in the previously described pretensioned condition wherein the panel members are urged toward one another. Referring now to FIG. 8 there is shown a partial view housing 10 illustrating the structional relationship and positioning of one of the corner members, 20*b*, with respect to roof member 22*b* and base 12. It can be seen that once housing 10 is assembled and the roof members are installed, corner member 20*b* is precluded from movement away from housing 10 and base 12 which would be the right-hand position of FIG. 8. It will now be appreciated that corner member 20*b* is essentially captured in its installed position by roof member 22*b* and roof member 22*d* is rigidly retained in a press-fit frictional and pretensioned engagement with the front and rear panel members. Thus, the completed assembly is essentially inter-locking and provides a relatively rigid assembly without the use of fasteners or any permanent fastening technique.

It will be appreciated by those skilled in the art that the various members of the housing in accordance with the present invention can be provided of any desired material such as wood, fiberboard, millboard, pressboard and the like, and including metallic materials. Further, the slotted members can also be provided as molded or cast members, thereby avoiding machining or milling operations. Further, the corner members can be permanently attached to one of the mating side or panel members, or provided as an integral portion thereof. It will also be appreciated that the lengths of the various slots can be significantly reduced wherein the mating members are provided with corresponding tabs, etc. Of course, the dimensions of any one or all of the members of the housing, in accordance with the principles of the present invention, can be varied to meet the needs of a given application.

What has been taught, then, is a decorative housing which forms a small-scale replica of a dwelling or the like and which is provided of a knockdown construction facilitating, notably, repeated assembly and disassembly of the housing. Advantageously, the housing can be manufactured, sold and stored essentially in the form of a kit, and which is readily and conveniently erectable in accordance with the teachings of the present invention. The form of the invention illustrated and described herein is the preferred embodiment of these teachings in the form currently preferred for manufacture. It is shown as an illustration of the inventive concept, however, rather than by way of limitation, and it is pointed out that various modifications and alterations may be indulged in with the scope of the appended claims.

What I claim as new and desire to protect by United States Letters Patent is:

1. A housing forming a small-scale replica of a dwelling or the like, comprising, in combination:

a base having at least one shot therein on one surface thereof and extending along at least a substantial portion of the peripheral edge thereof;

a front panel member and a rear panel member removably insertable in said slot of said base;

a pair of side members removably insertable into said slot at respective opposite ends of said panel members;

a plurality of vertically extending corner members respectively disposed at each intersection of said panel and side members wherein each corner member includes at least one slot for receiving a vertically extending edge portion of at least one of said panel and side members;

a roof including at least one roof member each having a pair of slots therein for removably receiving the upper edge portions of said panel members in press-fit frictional engagement therewith;

wherein said base is rectangular, wherein said panel members include a triangular upper portion the apex of which forms a peak and wherein said roof includes first and second peaked roof members which when assembled with said panel members form a peaked roof; and, wherein there is provided four corner members each having a pair of transversely disposed slots therein extending the entire length thereof and wherein each of said corner members includes an inclined upper surface for engaging the assembled inclined surface of one of said roof members so that said corner members are captured by said roof members in their assembled configuration wherein horizontally outward movement of said corner members is precluded by the engagement of said inclined surfaces with said roof members.

2. The housing according to claim 1, wherein the distance between the parallel slots of said roof members is less than the corresponding distance between the slots of said base wherein said panels are resiliently urged toward one another.

3. The housing according to claim 2, wherein said front panel is provided with a central cut-out opening the edges of which form a simulated entrance way and fence portions.

4. The housing according to claim 3, wherein said rear panel includes a plurality of apertures therein for receiving electrical sockets therein.

5. The housing according to claim 4 wherein said panels and side members are formed from $\frac{1}{4}$ inch panels and wherein the slots which receive said panels are generally rectangular and having a slot width on the order of $\frac{1}{4}$ inch thereby to provide a zero clearance interference fit.

6. The housing according to claim 1, wherein the spacing between said pair of slots is selected to provide a pretensioning between said panel members when said housing is assembled wherein said panel members are urged toward one another and against said corner members.

7. A housing in the form of a replica of a stable and which may be assembled and disassembled repeatedly and without the use of permanent fasteners, said housing comprising: a generally rectangular base having slots provided near the peripheral edges on the upper surface thereof; front and rear panel members respectively inserted into a parallel pair of slots along the longer dimension of base; a pair of side members respectively inserted into a second pair of parallel slots disposed along the shorter dimension of said base; the vertical edges of the panel and side members being respectively received within corresponding slots of four corner members wherein each corner member includes a pair of transversely oriented slots and an inclined upper surface; first and second generally rectangular, peaked roof members each provided with a pair of parallel slots on the lower surfaces thereof and along the longer dimensions thereof, wherein the upper edges of the panel members extend above said inclined surfaces of said corner members and are received within the corresponding slots of said roof members in press-fit frictional engagement therewith; and, wherein the spacing of said roof member slots pretensions and urges said panel members toward one another, and wherein the engagement of said inclined surfaces with said sloped roof members precludes horizontal translation of the assembled corner members.

* * * * *